US006357191B1

(12) United States Patent
Ault et al.

(10) Patent No.: US 6,357,191 B1
(45) Date of Patent: Mar. 19, 2002

(54) COMPOSITE DECK

(75) Inventors: Robert L. Ault, Saltsburg; Thomas G. Ryan, North Huntingdon; David F. Landis, Pittsburgh, all of PA (US)

(73) Assignee: Epic Metals Corporation, Rankin, PA (US)

( * ) Notice: Subject to any disclaimer, the term of this patent is extended or adjusted under 35 U.S.C. 154(b) by 0 days.

(21) Appl. No.: 09/498,224

(22) Filed: Feb. 3, 2000

(51) Int. Cl.[7] ..... E04B 1/20; E04B 5/18

(52) U.S. Cl. ..... 52/336; 52/252; 52/263; 52/334; 52/450; 52/674; 29/457; 29/897.34

(58) Field of Search ..... 52/231, 252, 263, 52/334, 336, 449, 451, 452, 453, 454, 329, 330, 414, 673, 674, 630, 450; 29/879.32, 897.34, 437; 72/284, 379.6

(56) References Cited

U.S. PATENT DOCUMENTS

| | | | | | |
|---|---|---|---|---|---|
| 867,251 | A | | 10/1907 | Davis | |
| 910,757 | A | | 1/1909 | Wilson | |
| 2,001,733 | A | * | 5/1935 | Kellogg | |
| 3,496,691 | A | * | 2/1970 | Seaburg et al. | |
| 3,583,123 | A | * | 6/1971 | Holmgreen | 52/584 |
| 3,596,421 | A | | 8/1971 | Miller | |
| 3,715,846 | A | * | 2/1973 | Sullhofer | 52/309 |
| 3,792,560 | A | * | 2/1974 | Naylor | 52/364 |
| 3,802,147 | A | * | 4/1974 | O'Konski | 52/630 |
| 3,812,636 | A | | 5/1974 | Albrecht et al. | |
| 3,967,426 | A | * | 7/1976 | Ault et al. | 52/252 |
| 4,527,372 | A | | 7/1985 | Ryan | |
| 5,020,295 | A | * | 6/1991 | Haines et al. | 52/630 |
| 5,107,650 | A | | 4/1992 | Patrick | |
| 5,259,157 | A | | 11/1993 | Ault | |
| 5,566,522 | A | | 10/1996 | Ålander et al. | |

* cited by examiner

*Primary Examiner*—Carl D. Friedman
*Assistant Examiner*—Yvonne M. Horton
(74) *Attorney, Agent, or Firm*—Webb Ziesenheim Logsdon Orkin & Hanson, P.C.

(57) ABSTRACT

A ribbed metal plate for a composite slab that includes a substantially planar plate having an upper surface and a lower surface and a plurality of laterally-spaced, longitudinally-extending ribs that have a keystone profile and wherein the sidewalls are angled toward each other. Ends of the ribs are integrally formed. The rib plate is secured to bearing walls in a structure and concrete is poured on the ribs to form a composite deck. The ends of the ribs extend in the lateral direction to form a composite structure retarding movement of cured concrete in a longitudinal direction. The ribbed plate can also be used in composite beams.

20 Claims, 4 Drawing Sheets

COMPOSITE DECK

BACKGROUND OF THE INVENTION

1. Field of the Invention

The present invention relates to composite roof and floor deck assemblies.

2. Description of the Prior Art

It is well known in the art to provide a composite floor structure or deck having corrugated or ribbed metal sheets and concrete slabs supported on beams such as that disclosed in U.S. Pat. No. 4,527,372. These composite floor structures provide composite action between the overlying concrete slab and the corrugated sheet. Typically, these concrete slabs have been poured in place after the ribbed metal sheets have been secured to a structure. The concrete interacts with supporting I-beams having studs to prevent shear failure primarily between the concrete slab and the supporting I-beam and secondarily between the concrete slab and the corrugated decking, such as shown in U.S. Pat. No. 4,527,372. However, in some cases it is advantageous to attach the composite decking directly to wall structures, which may not require studs to be attached. In other cases, studs may not be provided. In either case, where studs are not provided, the possibility of shear failure of the concrete slab with the metal decking increases if the stud was the primary shear connector between the slab and metal deck. Further, U.S. Pat. No. 4,527,372 discloses the metal sheet ribs having closed ends so that the concrete poured to form the slab is prevented from entering into a hollow area defined by an inner surface of each rib.

Further, in cases where open-ended ribs are used in decking, problems exist with rodents and insects traveling within the ribs. This enables the rodents and insects to travel to various rooms and can be a problem in apartment buildings and condominiums. Furthermore, open-ended ribs provide little barriers for sound proofing. Typically, sound will travel through the ribs. Therefore, open-ended ribs may affect the privacy of adjacent apartments and condominiums because sound will travel through the open-ended ribs to adjacent units.

Therefore, it is an object of the present invention to provide a structurally sound, inexpensive and improved composite deck.

It is another object of the present invention to provide a composite deck with improved sound proofing qualities.

It is another object of the present invention to provide a composite deck with improved rodent and insect control.

SUMMARY OF THE INVENTION

The present invention is a ribbed plate for a composite deck that includes a substantially planar plate having an upper surface and a lower surface, and a plurality of laterally-spaced, longitudinally-extending protruding ribs. Each of the ribs includes spaced apart sidewalls connected to a top wall. The walls are angled toward each other. The laterally-spaced, longitudinally-extending ribs extend from a first end of the planar plate to a second end of the planar plate. Each of the longitudinally-extending ribs has a first end and a second end that are closed, thereby defining a hollow chamber. When the upper surface of the planar plate is embedded in concrete, the concrete is prevented from flowing into the hollow rib chamber through the rib-closed first end and the closed end second end. Preferably, the rib-closed first end and rib-closed second end are integrally formed. A recessed concrete receiving area is defined and the rib-closed first end and the rib-closed second end extend along the lateral direction.

The recessed concrete receiving area is defined by one of the rib sidewalls, and adjacent portion of the planar plate and respective portions of the rib-closed first end and the rib-closed second end. Preferably, the rib plate is made of metal. Preferably, the top wall of each of the rib-closed first end the rib-closed second end slopes in a downwardly direction toward the adjacent planar first portions. Each of the ribs has a rib body positioned between the rib-closed first end and the rib-closed second end, wherein the rib body has one of a keystone or triangular profile. Each of the hollow rib chambers includes an open passageway defined on the lower surface of the substantially planar plate. Alternatively, the ribs are closed adjacent to the lower surface of the planar plate. Each of the rib bodies has a lateral width that decreases from the top wall toward the bottom surface. The planar plates can have lateral ends that each define portions of a rib so that a rib can be formed by adjacent lateral ribs of adjacent ribbed plates. The plate can also include an embossment extending from at least one of the top surfaces and/or walls of the ribs at the rib-closed first and rib-closed second ends and the plate positioned between adjacent ones of the ribs.

The present invention is also a composite deck that includes the above-described ribbed plate and a concrete layer positioned on the upper surface of the ribbed plate, whereby concrete surrounds the ribs and the ribs are embedded in the concrete. The ribbed sidewalls retard movement of the concrete, when the concrete layer is cured, in a lateral direction and portions of the rib-closed first ends and the rib-closed second ends retard movement of the cured concrete layer in the longitudinal direction. A plaster layer can be formed directly on the lower surface of the ribbed plate.

The present invention is also a structure that includes at least two longitudinally-spaced bearing walls and the above-described composite deck attached to the bearing walls. The bearing walls can be either a concrete wall or steel wall.

Furthermore, the present invention is a method for forming a ribbed plate for a composite deck that includes the steps of: (a) forming a plurality of laterally-spaced, longitudinally-extending ribs, wherein each of the ribs has a top wall connected to two converging sidewalls, a first end and longitudinally-spaced second end; and (b) deforming each of the rib ends so that the rib ends extend in a lateral direction and are closed. The method further includes the step of forming embossments on the top wall of at least one rib or on the plate positioned between adjacent ones of the ribs.

DESCRIPTIONS OF THE PREFERRED EMBODIMENTS

Figure 1:
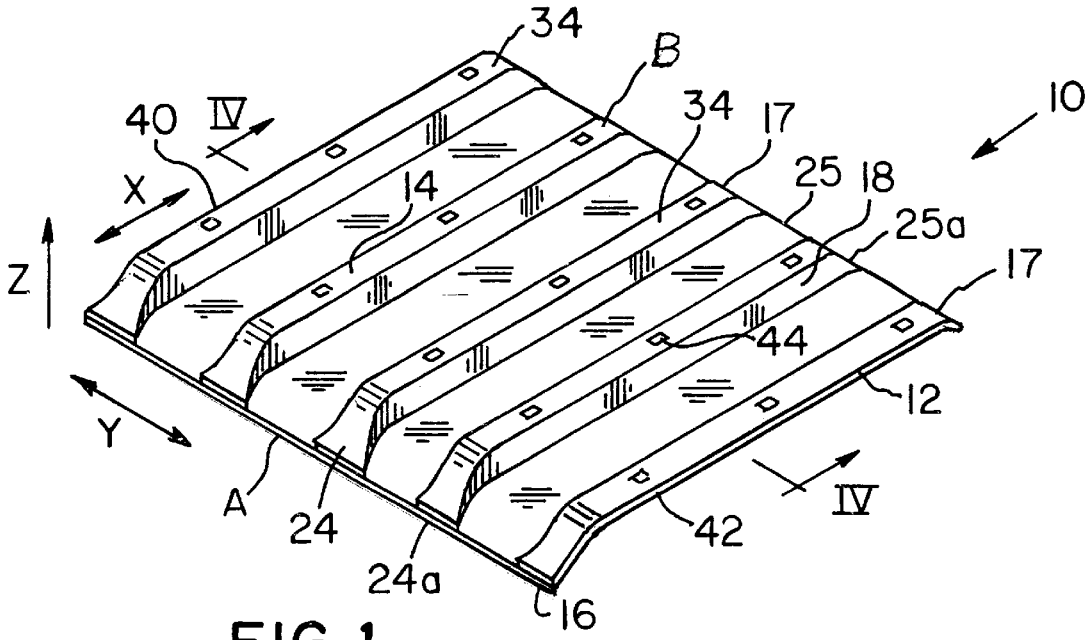
FIG. 1 is a top perspective view of a portion of the ribbed plate for a composite deck made in accordance with the present invention.
Figure 2:
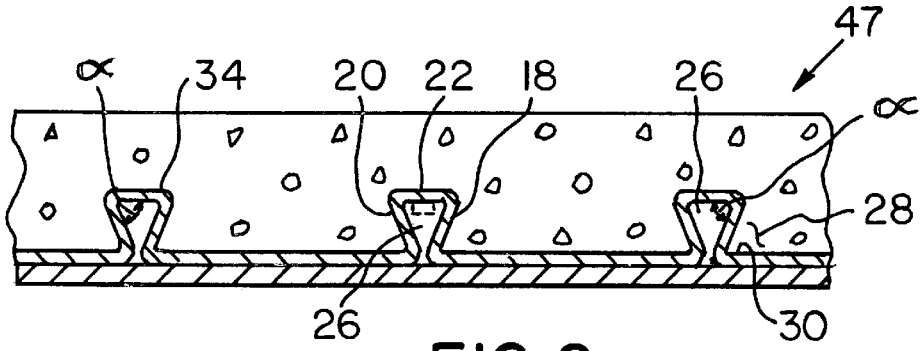
FIG. 2 is a sectional elevational view of a portion of a composite deck including the ribbed plate shown in FIG. 1, made in accordance with the present invention.

FIGS. 1–6B show a ribbed plate 10 for a composite deck made in accordance with the present invention. The ribbed plate 10 includes a substantially planar plate 12 having an upper surface 14, a lower surface 16 and longitudinally-spaced ends A and B. A plurality of laterally-spaced, longitudinally-extending protruding ribs 17 is provided. As can be seen, the ribs 17 define a keystone profile. Each of the ribs 17 includes laterally-spaced apart sidewalls 18 and 20 attached to a top wall 22 at one end. As shown in FIG. 2, the sidewalls 18 and 20 are angled at an angle a toward each other. Referring back to FIG. 1, the ribs 17 extend from a first end 24 to a second end 25 in a longitudinal direction defined along an axis X. A lateral direction is defined along axis Y and a vertical direction as defined by an axis Z as shown in FIG. 1. The first end 24 and the second end 25 of each rib 17 are closed. The closed first ends 24 and the second ends 25 of the ribs 17 are formed by crushing or deforming adjacent portions of the ribs 17, as will be explained below. Each of the ribs 17 defines a hollow rib chamber 26 as shown in FIG. 2. The rib sidewalls 18 and 20 define a recessed area 28 which is defined in part by the respective sidewalls 18 and 20 and a planar portion 30.

The planar portion 30 is adjacent to respective sidewalls 18 and 20. Each of the first end 24 and second end 25 has respective portions 24A and 25A that extend along a lateral direction Y at the ends of the recessed area 28. Therefore, each recessed area 28 is defined by at least four sides, namely one of the sidewalls 18 and 20, an adjacent planar portion 30 and portions 24A and 25A of the first end 24 and the second end 25 that extend along the Y axis.

Figure 3:
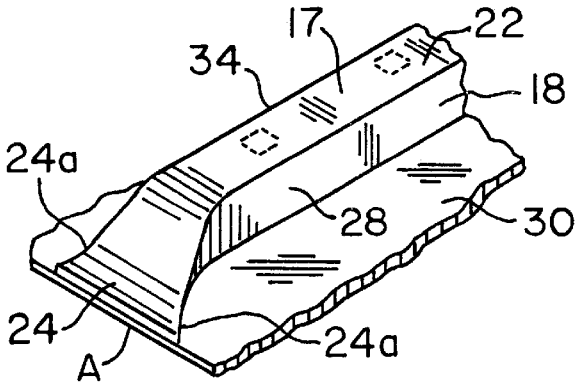
FIG. 3 is a top perspective view, partially in section, of a portion of the ribbed plate shown in FIG. 1.
Figure 4:
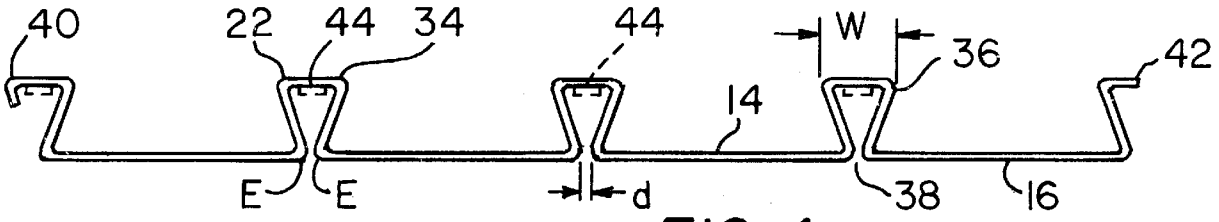
FIG. 4 is a view of a section taken along lines IV—IV of FIG. 1.

Referring to FIG. 3, each of the first end 24 and second end 25 (not shown) slopes in a downwardly direction toward an adjacent planar portion 30. Each of the ribs 17 also includes a rib body portion 34 positioned between the first end 24 and second end 25. Preferably, as shown in FIG. 4, the rib body portion 34 has a triangular or keystone profile 36. Preferably, adjacent ends E of sidewalls 18 and 20 opposite top wall 22 are either touching or in close proximity to each other. In the case the ends E of the sidewalls 18 and 20 do not touch, an open passageway 38 is defined. It is an advantage of the present invention that the lower surface 16 can be either painted or coated with a thin coat of plaster without the need of additional construction material to close the joint or passageway 38 defined by ends E.

Figure 6A:
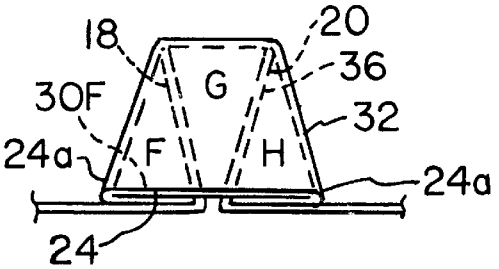
FIG. 6A is an end elevational view of a rib of a portion of the ribbed plate shown in FIG. 1.
Figure 6B:
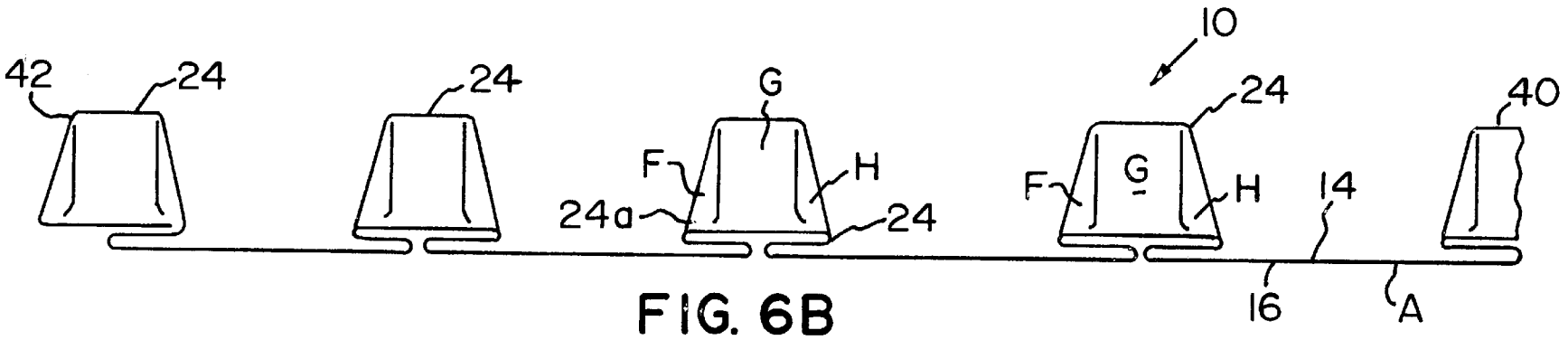
FIG. 6B is an end elevational view of the ribbed plate shown in FIG. 1.

As stated previously, it is preferred that the profile 36 is triangular or keystone in shape so that the rib body has a lateral width W that decreases to a lateral width d from the top wall 22 toward the upper surface 14. Further, preferably, the rib plate 10 is made of metal, although it is believed that other materials may be used. Furthermore, as shown in FIG. 4, preferably, each of the ribbed plates 10 include lateral ends 40 and 42 that define portions of the longitudinally-extending ribs. In this manner, adjacent lateral ends 40 and 42 may be placed on top of each other to define a completed rib 17. More specifically, as shown in FIGS. 6A and 6B, portions F and H of lateral ends 24 and 25 (of which only end 24 is shown) extend outwardly in the lateral direction relative to the rib profile G. Hence, referring to FIG. 6A, recessed areas are defined between respective portions F of ends 24 and 25, wall 18 and planar portion 30F, and portions H of ends 24 and 25, wall 20, and planar portion 30H.

Figure 7A:
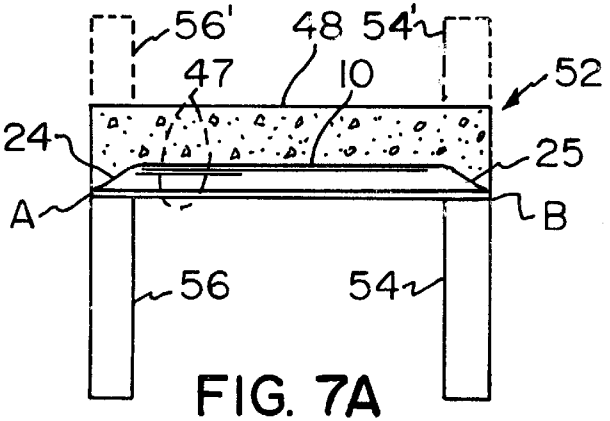
FIG. 7A is an elevation of a structure including two walls and a composite deck made in accordance with the present invention.

Referring to FIG. 7A, in operation, the rib plate 10 is supported at adjacent ends A and B by bearing walls 54 and 56 or other types of supporting members. Concrete is then poured on the upper surface 14 embedding the upper surface 14 in concrete and surrounding the ribs 17 to form a composite slab 47 that includes a concrete portion 48 and the ribbed plate 10. After the concrete cures, the composite slab 47 is formed and can be used, for example, as a roof or a floor. Concrete contacts various portions of the ribbed plate 10 and by at least a first end portion 24A and a second end portion 25A of each rib 17, as well as respective sidewalls 18 and 20 and planar portions 30. As shown in FIG. 4, preferably, the ribs 17 have embossments 44 shown in phantom, positioned on the ribs 17. Small longitudinally-extending corrugations (not shown) may also be provided between the ribs 17 to add stiffness to the plate 10 in the longitudinal direction. The embossments 44 provide an interlock with the concrete to prevent slippage. It is believed that the embossments 44 and the recessed areas 28 defined by the sidewalls 18 and 20, the first end portions 24A and the second end portions 25A of respective ribs 17 and the planar portions 30 prevent the shear failure between the cured concrete 48 and the ribbed plate 10 in the longitudinal direction X. More specifically, it is believed that the rib sidewalls 18 and 20 retard movement of the cured concrete portion 48 in the lateral direction Y and the vertical direction Z and the portions of the first ends 24A and the second end portions 25A of the ribs 17 retard movement of the cured concrete portion 48 in the longitudinal direction X. This results in a stronger composite floor 47 than without the closed end portions 24A and 25A. It is important to note also that the closed ends 24 and 25 prevent concrete from flowing into the hollow rib chamber 26. Also, the present invention permits a thin coat of plaster 50 (as shown in FIG. 2) to be directly applied to the lower surface 16 of the planar plate as opposed to the need of taping the open passageways 38, especially if the adjacent ends E of the ribs 17 contact each other at the lower surface 16. Alternatively, the lower surface 16 can be painted.

The present invention enables a structure 52 to be built wherein the composite deck 47 can be directly secured or supported by bearing walls 54 and 56 as opposed to supporting the composite deck 47 to I-beams as shown in U.S. Pat. No. 4,527,372. The walls 54 and 56 can be made of masonry, concrete, metal or wood. The present invention prevents rodents and insects from traveling between adjacent composite decks because of the closed ends 24 and 25. Further, the closed ends 24 and 25 improve sound proofing between adjacent rooms because the ribs 17 are closed and concrete is poured between adjacent composite decks 47. Also, the present plates are one piece and relatively inexpensive to manufacture. Also, the present invention prevents cement from flowing into the ends 24 and 25. Further, the present invention provides less stress concentrations in the composite slabs at the end of the plates 10 than the prior art because of the smooth transition of the plate at the ends 24 and 25. Furthermore, it is believed the composite deck 47 can take increased loads over decks without closed and flared ends in the lateral direction because of the plates 10 ability to retard shearing of the concrete in both the longitudinal and lateral directions.

Figure 7B:
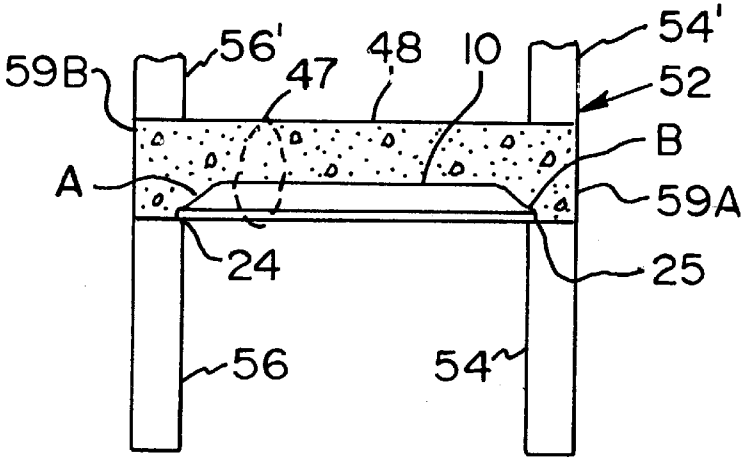
FIG. 7B is an elevation of a structure similar to that shown in FIG. 7A, except with a concrete haunch.

FIG. 7B shows a structure 52' similar to structure 52 except for the below noted differences. Like reference numerals will be used for like elements. As can be seen, the structure 52' further includes bearing walls 54' and 56'. The plate 10 is positioned between the walls so that haunches 59A and 59B are provided. The haunches 59A and 59B are solid concrete or cement portions positioned between the respective walls 54 and 54', and 56 and 56'. It is believed this arrangement results in a stronger multistory structure in compression as opposed to having the plate 10 run to the end of the walls 54 and 56 as shown in FIG. 7A, where less concrete would be positioned between vertically spaced walls 54 and 54', and 56 and 56', respectively.

Figure 8:
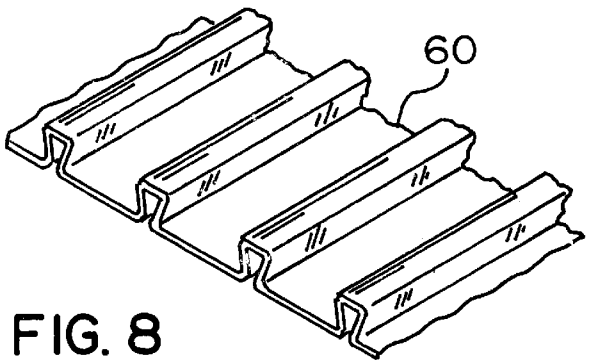
FIG. 8 is a ribbed plate with open ends prior to the closing of the ends.
Figure 5:
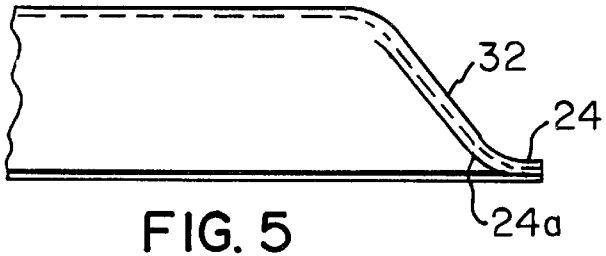
FIG. 5 is a side elevational view of a portion of an end of a rib of the ribbed plate shown in FIG. 1.

The present invention is also a method for making the previously identified ribbed plate 10 for a composite deck that includes the steps of: (a) forming an initial profile 60 in deformable metal material wherein the ribs are not closed at their ends as shown in FIG. 8; and (b) deforming the ends of the ribs 17 of the initial profile 60 so as to form closed first ends 24 and 25 with flared out portions 24A and 25A as shown in FIG. 1. Preferably, the ends are deformed by crushing. The present invention results in an inexpensive and strong composite deck as compared to that of the prior art.

Figure 9:
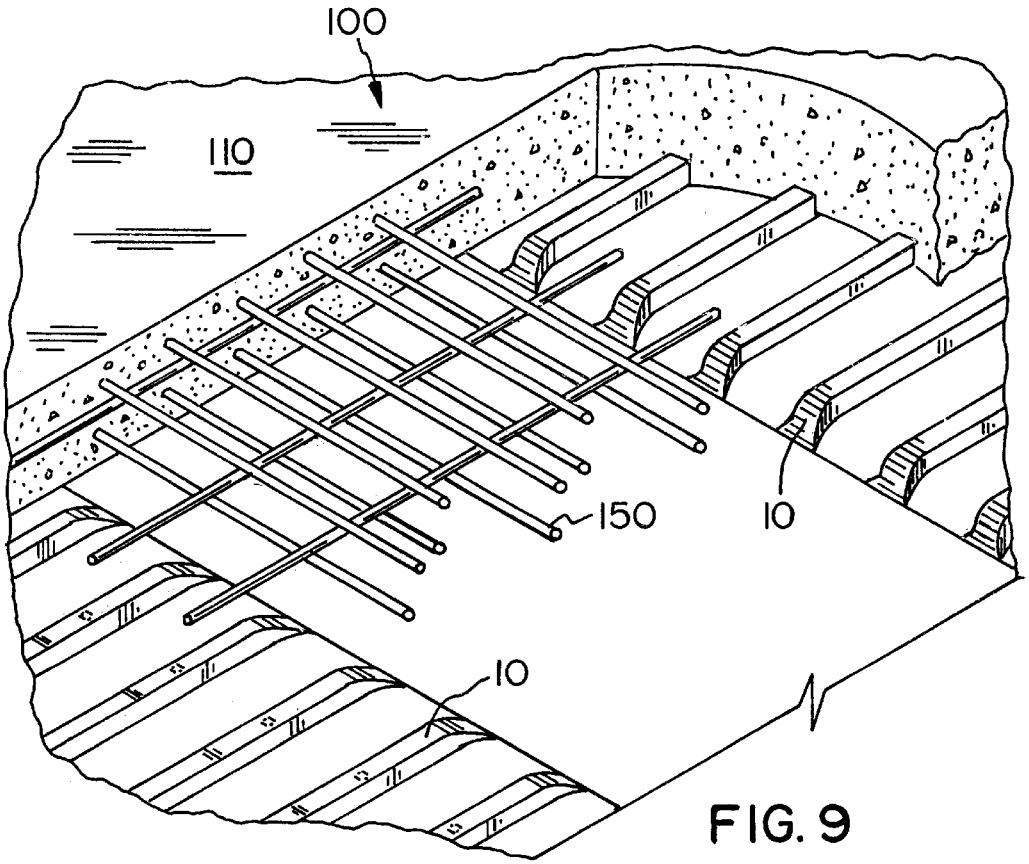
FIG. 9 is a top-perspective view, partially in section, of a portion of a reinforced composite slab beam made in accordance with the present invention.
Figure 10:
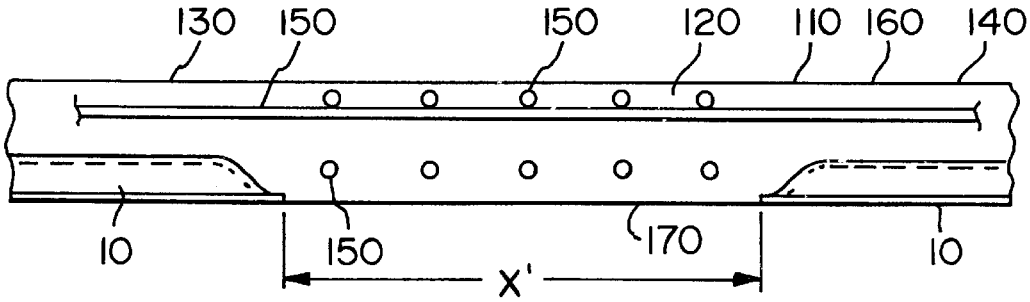
FIG. 10 is a partial sectional elevational view of a portion of the reinforced composite beam shown in FIG. 9.

FIGS. 9 and 10 show another embodiment of the present invention. Specifically, FIGS. 9 and 10 show a reinforced composite slab beam 100 which is similar to a composite slab beam shown in U.S. Pat. No. 3,967,426, which is hereby incorporated by reference, except the plates described in U.S. Pat. No. 3,967,426 are replaced by plates 10. The composite slab beam 100 includes two plates 10 spaced longitudinally apart a distance X'. The plates 10 are embedded in a continuous concrete layer 110 positioned on upper surfaces 14 of the ribbed plates 10, whereby concrete surrounds the ribs 17 and the ribs 17 are embedded in concrete. In this arrangement, a concrete beam 120 is defined between composite beam/concrete sections 130 and 140 and is integral therewith. The concrete beam 120 is also defined between the two longitudinally-spaced plates 10. Reinforcing transverse bars and/or cables 150 can also be provided and embedded in the concrete. The composite slab beam 100 has an upper planar surface 160 contained in a first plane and a lower planar surface 170 contained in a second plane parallel to the first plane. The concrete layer 120 can be supported by a pillar, as opposed to a load bearing wall. The plates 10 provide for a stronger composite slab beam 100 than the prior art because the plates 10 retard longitudinal and lateral movement of the concrete layer as previously described.

Having described the presently preferred embodiments of the invention, it is to be understood that it may otherwise be embodied within the scope of the appended claims.

What is claimed:

1. A ribbed plate for a composite deck, comprising:

a substantially planar plate having an upper surface and a lower surface; and a plurality of laterally-spaced, longitudinally-extending protruding ribs, each of said ribs includes spaced apart sidewalls connected to a top wall, said sidewalls angled toward each other and defining a rib profile, said laterally-spaced, longitudinally-extending ribs extending from a first end of said planar plate to a second end of said planar plate, each of said longitudinally-extending ribs having a first end and a second end that are closed thereby defining a hollow rib chamber, said rib-closed first end and said rib-closed second end extend along a lateral direction outwardly from and relative to the respective rib profile, a recessed concrete receiving area is defined by one of said rib sidewalls, an adjacent portion of said planar plate, and respective portions of said rib-closed first end and said rib-closed second end, whereby when said upper surface of said planar plate is embedded in concrete, the concrete is prevented from flowing into the hollow rib chamber through said closed rib first end and said closed rib second end.

2. A ribbed plate as claimed in claim 1, wherein said rib-closed first end and said rib-closed second end are formed by crushing.

3. A ribbed plate as claimed in claim 1, wherein said top wall of each of said rib-closed first end and said rib-closed second end slopes in a downwardly direction toward said adjacent planar plate portions.

4. A ribbed plate as claimed in claim 1, wherein each of said ribs has a rib body positioned between said rib-closed first end and said rib-closed second end, wherein said rib body has one of a keystone or triangular profile.

5. A ribbed plate as claimed in claim 1, wherein each of the hollow rib chambers includes an open passageway defined on said lower surface of said substantially planar plate.

6. A ribbed plate as claimed in claim 4, wherein each of said rib bodies has a lateral width that decreases from said top wall toward said bottom surface.

7. A ribbed plate as claimed in claim 1, wherein said ribbed plate is made from a single sheet of metal.

8. A ribbed plate as claimed in claim 1, wherein said ribs are closed adjacent to said lower surface of said planar plate.

9. A ribbed plate as claimed in claim 1, wherein said substantially planar plate has lateral ends that each define portions of a rib so that a rib is formed by adjacent lateral ends of adjacent ribbed plates.

10. A ribbed plate as claimed in claim 1, wherein said plate further comprising an embossment positioned in a top wall in at least one of said ribs.

11. A composite deck comprising:

a ribbed substantially planar plate having an upper surface and a lower surface, and a plurality of laterally-spaced, longitudinally-extending protruding ribs, each of said ribs includes spaced apart sidewalls connected to a top wall, said sidewalls angled toward each other and defining a rib profile, said laterally-spaced, longitudinally-extending ribs extending from a first end of said planar plate to a second end of said planar plate, each of said longitudinally-extending ribs having a first end and a second end that are closed thereby defining a hollow rib chamber, said rib-closed first end and said rib-closed second end extend along a lateral direction outwardly from and relative to the respective rib profile, a recessed concrete receiving area is defined by one of said rib sidewalls, an adjacent portion of said planar plate, and respective portions of said rib-closed first end and said rib-closed second end, whereby when said upper surface of said planar plate is embedded in concrete the concrete is prevented from flow into the hollow rib chamber through said closed rib first end and said closed rib second end; and a concrete layer positioned on said upper surface of said ribbed plate, whereby concrete surrounds said ribs and said ribs are embedded in said concrete.

12. A composite deck as claimed in claim 11, wherein said rib sidewalls retard movement of said concrete layer, when said concrete layer has cured, in a lateral direction and portions of said rib-closed first ends and said rib-closed second ends retard movement of said cured concrete layer in a longitudinal direction.

13. A composite deck as claimed in claim 12, wherein said rib sidewalls further retard movement of said cured concrete in a vertical direction.

14. A structure comprising at least two longitudinally-spaced support members and a composite deck attached to said support members, wherein the composite deck comprises:

a ribbed substantially planar plate having an upper surface and a lower surface, and a plurality of laterally-spaced, longitudinally-extending protruding ribs, each of said ribs includes spaced apart sidewalls connected to a top wall, said sidewalls angled toward each other and defining a rib profile, said laterally-spaced, longitudinally-extending ribs extending from a first end of said planar plate to a second end of said planar plate, each of said longitudinally-extending ribs having a first end and a second end that are closed thereby defining a hollow rib chamber, said rib-closed first end and said rib-closed second end extend along a lateral direction outwardly from and relative to the respective rib profile, a recessed concrete receiving area is defined by one of said rib sidewalls, an adjacent portion of said planar plate, and respective portions of said rib-closed first end and said rib-closed second end, whereby when said upper surface of said planar plate is embedded in concrete the concrete is prevented from flow into the hollow rib chamber through said closed rib first end and said closed rib second end; and a concrete layer positioned on said upper surface of said ribbed plate, whereby concrete surrounds said ribs and said ribs are embedded in said concrete, wherein said rib sidewalls retard movement of said concrete layer in a lateral direction and a vertical direction and portions of said first end and portions of said second end of each of said ribs retard movement of said concrete layer in a longitudinal direction.

15. A structure as claimed in claim 14, wherein a haunch is formed over at least one of said support members by said concrete layer.

16. A structure as claimed in claim 14, wherein said support members are bearing walls and a haunch is formed over each of said bearing walls by said concrete layer.

17. A structure as claimed in claim 16, wherein each haunch is a concrete member that rests directly on a respective one of said bearing walls.

18. A method for forming a ribbed plate for a composite deck comprising the steps of:

a) forming a plurality of laterally-spaced, longitudinally-extending ribs in a deformable metal member, wherein each of the ribs has a top wall connected to two converging sidewalls, a first end and a longitudinally-spaced second end; and b) crushing each of the rib ends so that the rib ends extend in a lateral direction and are closed.

19. A composite deck beam comprising at least two ribbed substantially planar plates, wherein each of said planar plates includes a ribbed substantially planar plate having an upper surface and a lower surface, and a plurality of laterally-spaced, longitudinally-extending protruding ribs, each of said ribs includes spaced apart sidewalls connected to a top wall, said sidewalls angled toward each other and defining a rib profile, said laterally-spaced, longitudinally-extending ribs extending from a first end of said planar plate to a second end of said planar plate, each of said longitudinally-extending ribs having a first end and a second end that are closed thereby defining a hollow rib chamber, said rib-closed first end and said rib-closed second end extend along a lateral direction outwardly from and relative to the respective rib profile, a recessed concrete receiving area is defined by one of said rib sidewalls, an adjacent portion of said planar plate, and respective portions of said rib-closed first end and said rib-closed second end, whereby when said upper surface of said planar plate is embedded in concrete the concrete is prevented from flow into the hollow rib chamber through said closed rib first end and said closed rib second end; and a continuous concrete layer positioned on said upper surface of said ribbed plates, whereby concrete surrounds said ribs and said ribs are embedded in said concrete, and wherein a concrete beam is spaced between said two longitudinally-spaced planar plates, and wherein said two planar plates are longitudinally-spaced by said concrete beam, said concrete beam being integral with said continuous concrete layer.

20. A composite deck beam as claimed in claim 19, further comprising a reinforcing member embedded in said concrete layer.

* * * * *

UNITED STATES PATENT AND TRADEMARK OFFICE

CERTIFICATE OF CORRECTION

PATENT NO. : 6,357,191 B1
DATED : March 19, 2002
INVENTOR(S) : Robert L. Ault et al.

It is certified that error appears in the above-identified patent and that said Letters Patent is hereby corrected as shown below:

Column 3,
Line 28, "angle a" should read -- angle *a* --.

Signed and Sealed this

Eighteenth Day of June, 2002

*Attest:*

*Attesting Officer*

JAMES E. ROGAN
*Director of the United States Patent and Trademark Office*